US009101193B1

(12) United States Patent
Liu

(10) Patent No.: US 9,101,193 B1
(45) Date of Patent: Aug. 11, 2015

(54) ILLUMINATING COSMETIC APPLICATOR

(71) Applicant: CHUEN CHURN CO., LTD., New Taipei (TW)

(72) Inventor: Chen-Ling Liu, New Taipei (TW)

(73) Assignee: CHUEN CHURN CO., LTD., New Taipei (TW)

( * ) Notice: Subject to any disclaimer, the term of this patent is extended or adjusted under 35 U.S.C. 154(b) by 0 days.

(21) Appl. No.: 14/467,313

(22) Filed: Aug. 25, 2014

(51) Int. Cl.

| | |
|---|---|
| ***A45D 33/32*** | (2006.01) |
| ***A45D 42/10*** | (2006.01) |
| ***A45D 42/02*** | (2006.01) |
| ***A45D 40/20*** | (2006.01) |
| ***A45D 40/26*** | (2006.01) |
| *A45D 40/00* | (2006.01) |
| *A45C 15/06* | (2006.01) |

(52) U.S. Cl.
CPC ..... *A45D 42/02* (2013.01); *A45D 33/32* (2013.01); *A45D 40/20* (2013.01); *A45D 40/262* (2013.01); *A45C 15/06* (2013.01); *A45D 2040/0006* (2013.01)

(58) Field of Classification Search
CPC ..... A45D 33/22; A45D 42/10; A45D 42/00; A45D 29/20; A45D 40/18; A45D 33/08; A45C 15/06; A45C 15/00; A45C 5/005; A45C 15/04; F21V 33/00
USPC ..... 132/288; 362/136, 137, 155; 206/823, 206/581; 401/126–130
See application file for complete search history.

(56) References Cited

U.S. PATENT DOCUMENTS

| | | | | |
|---|---|---|---|---|
| 2,185,149 | A * | 12/1939 | Hallbauer | 362/156 |
| 2,651,709 | A * | 9/1953 | Ross et al. | 362/577 |
| 2,789,207 | A * | 4/1957 | Novakovich | 362/135 |
| 3,217,154 | A * | 11/1965 | Owen | 362/136 |
| 4,032,772 | A * | 6/1977 | Mowbray | 362/136 |
| 4,905,128 | A * | 2/1990 | Caires | 362/109 |
| 5,036,441 | A * | 7/1991 | Herron | 362/95 |
| 7,758,267 | B1 * | 7/2010 | Zhang | 401/52 |
| 2005/0135088 | A1 * | 6/2005 | Helenowski | 362/136 |
| 2012/0281396 | A1 * | 11/2012 | Wu | 362/190 |
| 2013/0025614 | A1 * | 1/2013 | Morgan | 132/200 |

FOREIGN PATENT DOCUMENTS

WO WO 2009082867 A1 * 7/2009

OTHER PUBLICATIONS

Derwent 200826 Zhang Dressing pencil with illuminating fuction Jul. 25, 2006.*

* cited by examiner

*Primary Examiner* — Robyn Doan

(57) ABSTRACT

A cosmetic applicator is provided with a casing including a transparent glass and a mirror; a light and mount assembly disposed in the casing and including a seat, a light, a conductive member, a conductive biasing member, a battery, a moveable member, a stop member, and a case wherein the seat has a battery compartment for anchoring the conductive member, the conductive biasing member, the battery, and the moveable member; and a cosmetic element carrier releasably secured to the casing. A light of the light and mount assembly can automatically emit light after pulling the cosmetic element carrier out of the applicator.

7 Claims, 8 Drawing Sheets

ILLUMINATING COSMETIC APPLICATOR

BACKGROUND OF THE INVENTION

1. Field of the Invention

The invention relates to cosmetic applicators and more particularly to a cosmetic applicator having a light which can automatically emit light after pulling a cosmetic element carrier out of the applicator.

2. Description of Related Art

A conventional cosmetic applicator is shown in FIG. 8 and comprises a casing 10 including an internal space 11; a light and mount assembly 20 disposed in the space 11 and including a body 21, a sleeve 22 disposed in the body 21, a cover 23 hingedly secured to the casing 10 and having a mirror 231 on an inner surface, a switch 211 having a contact 2111 at one end partially exposed on the body 21, and a spring member 2112 anchored on the bottom of the space 11, a light 212 electrically connected to the switch 211 and partially exposed on the body 21, and a battery unit 213 electrically connected to the switch 211; and a lipstick carrier 30 having its lipstick inserted through the casing 10 into the sleeve 22 so that a complete cosmetic applicator is formed.

In a closed position of the cosmetic applicator, the cover 23 is closed onto the casing 10 to press down the contact 2111 by compressing the spring member 2112 so as to disconnect the light 212 from the battery unit 213 (i.e., the switch 211 being off and the light 212 being off). After opening the cover 23, the contact 2111 is sprang up by the expansion of the spring member 2112 so as to electrically connect the light 212 to the battery unit 213 (i.e., the switch 211 being on and the light 212 being on). Finally, the person may pull the lipstick carrier 30 out of the casing 10 for applying purposes.

However, the art of illuminating the lipstick carrier 30 by turning on the light 212 after opening the cover 23 is not desired. Thus, the need for improvement still exists.

SUMMARY OF THE INVENTION

It is therefore one object of the invention to provide a cosmetic applicator comprising a casing including an opening member on one surface, an opening element on the same surface as the opening member, a transparent glass fitted on the opening member, a mirror fitted on the opening element, and an internal space; a light and mount assembly disposed in the internal space and including a seat, a light, a conductive member, a conductive biasing member, a battery, a moveable member, a stop member, and a case wherein the seat has a battery compartment in a lower portion for anchoring the conductive member, the conductive biasing member, the battery, and the moveable member, and a channel communicating with the battery compartment; and wherein the light has one end passing through the channel to electrically connect to the conductive member and an other end spaced from the battery in an inoperative position; and a cosmetic element carrier includes a rear body and a front cosmetic element, and wherein the cosmetic element carrier is releasably secured to a rear end of the casing; wherein the moveable member includes a front pushing element engaging the battery; wherein the stop member is engaged with a rear opening of the battery compartment and has a central hole with a portion of the moveable member moveably disposed therein in the inoperative position; wherein the pushing element is greater than a diameter of the central hole and spaced apart from the central hole in the inoperative position; wherein an internally hollowed rear portion of the moveable member is secured to a front end of the case; and wherein the cosmetic element carrier includes a rear body and a front cosmetic element disposed in the case.

The above and other objects, features and advantages of the invention will become apparent from the following detailed description taken with the accompanying drawings.

DETAILED DESCRIPTION OF THE INVENTION

Figure 1:
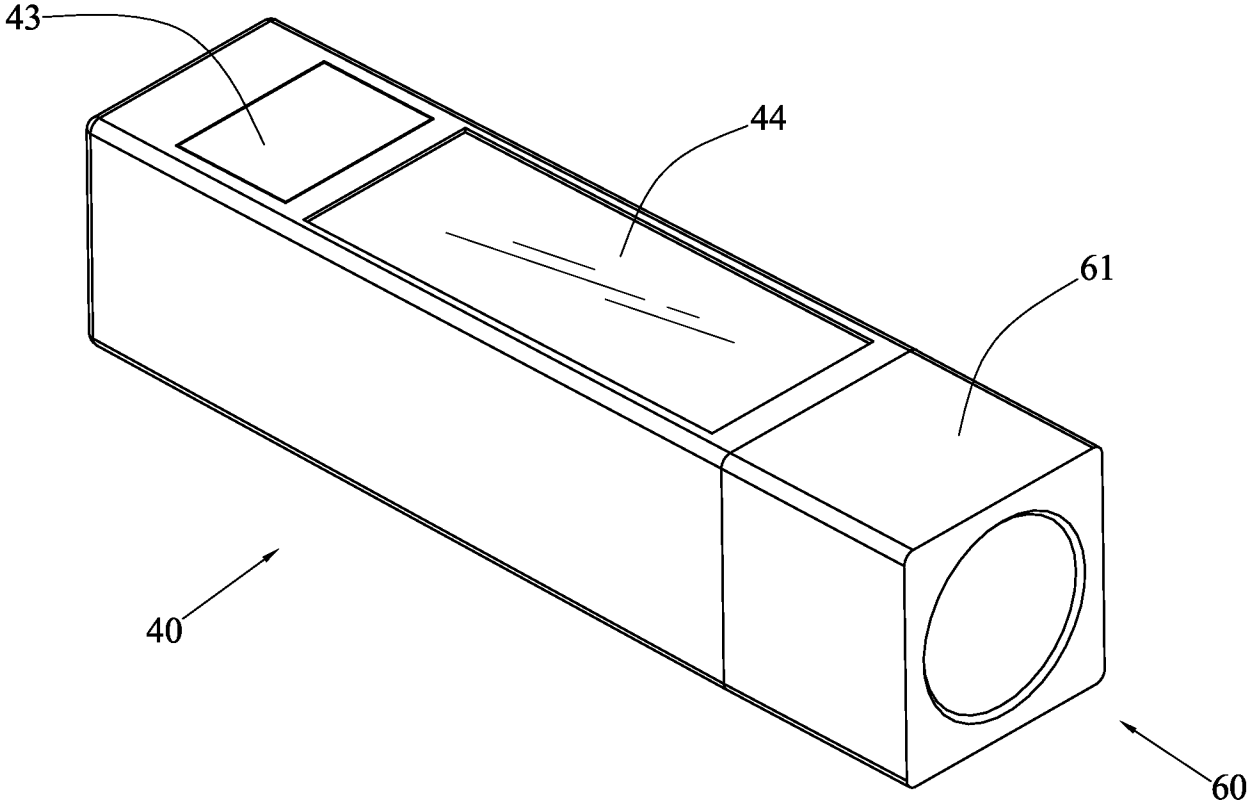
FIG. 1 is a perspective view of a cosmetic applicator according to the invention.
Figure 2:
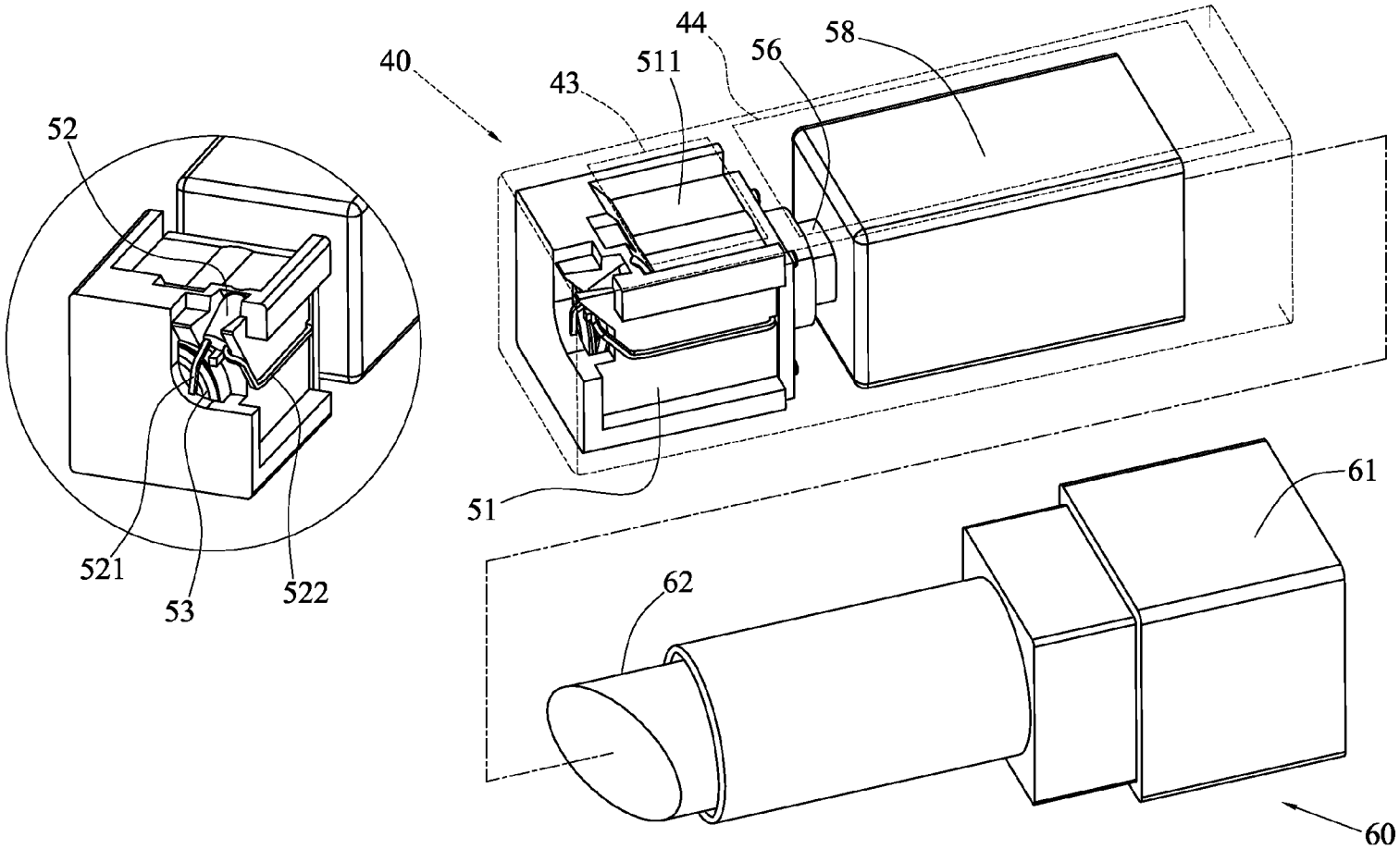
FIG. 2 is an exploded view of the cosmetic applicator.
Figure 3:
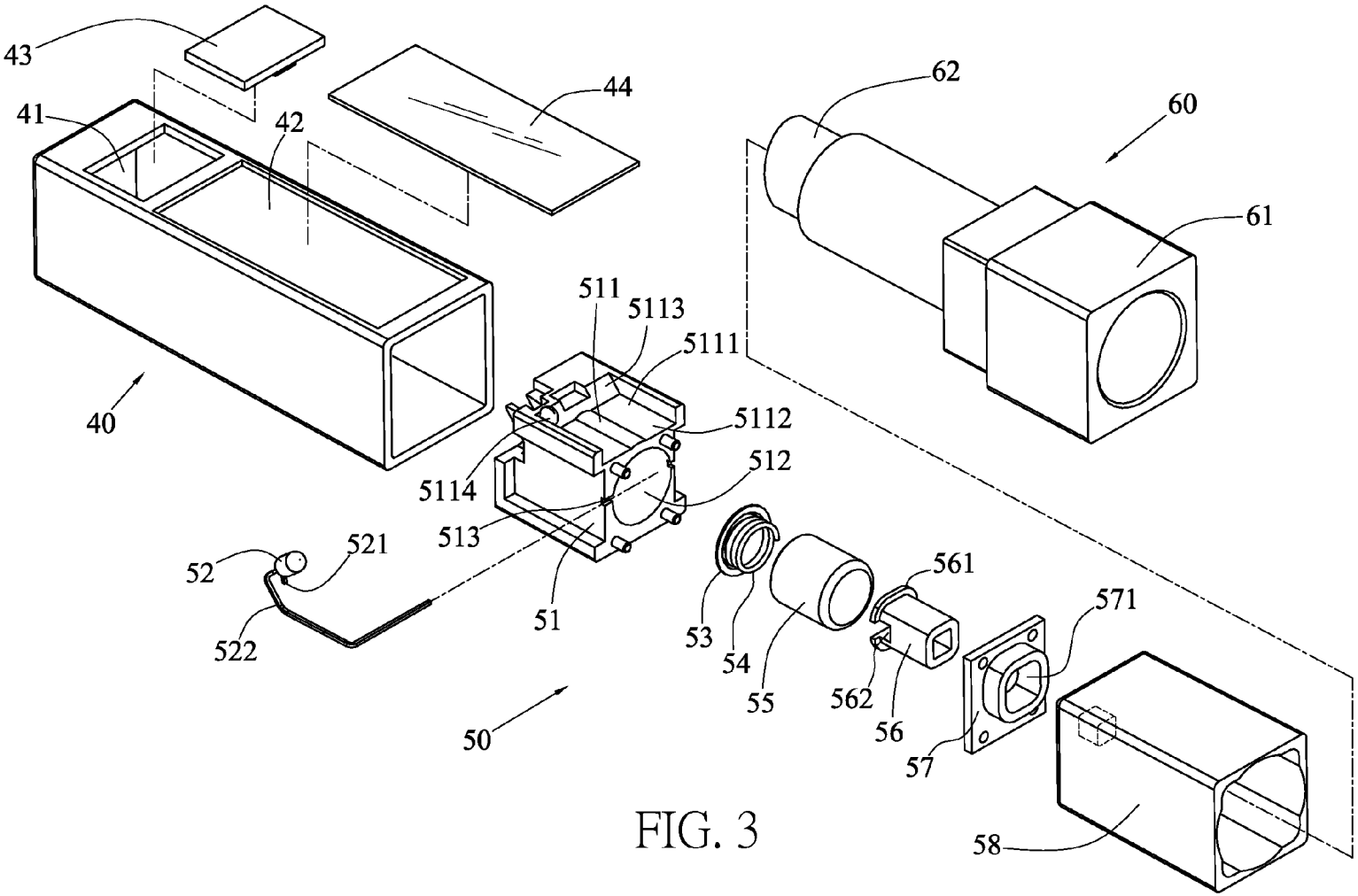
FIG. 3 is another exploded view of the cosmetic applicator.
Figure 4:
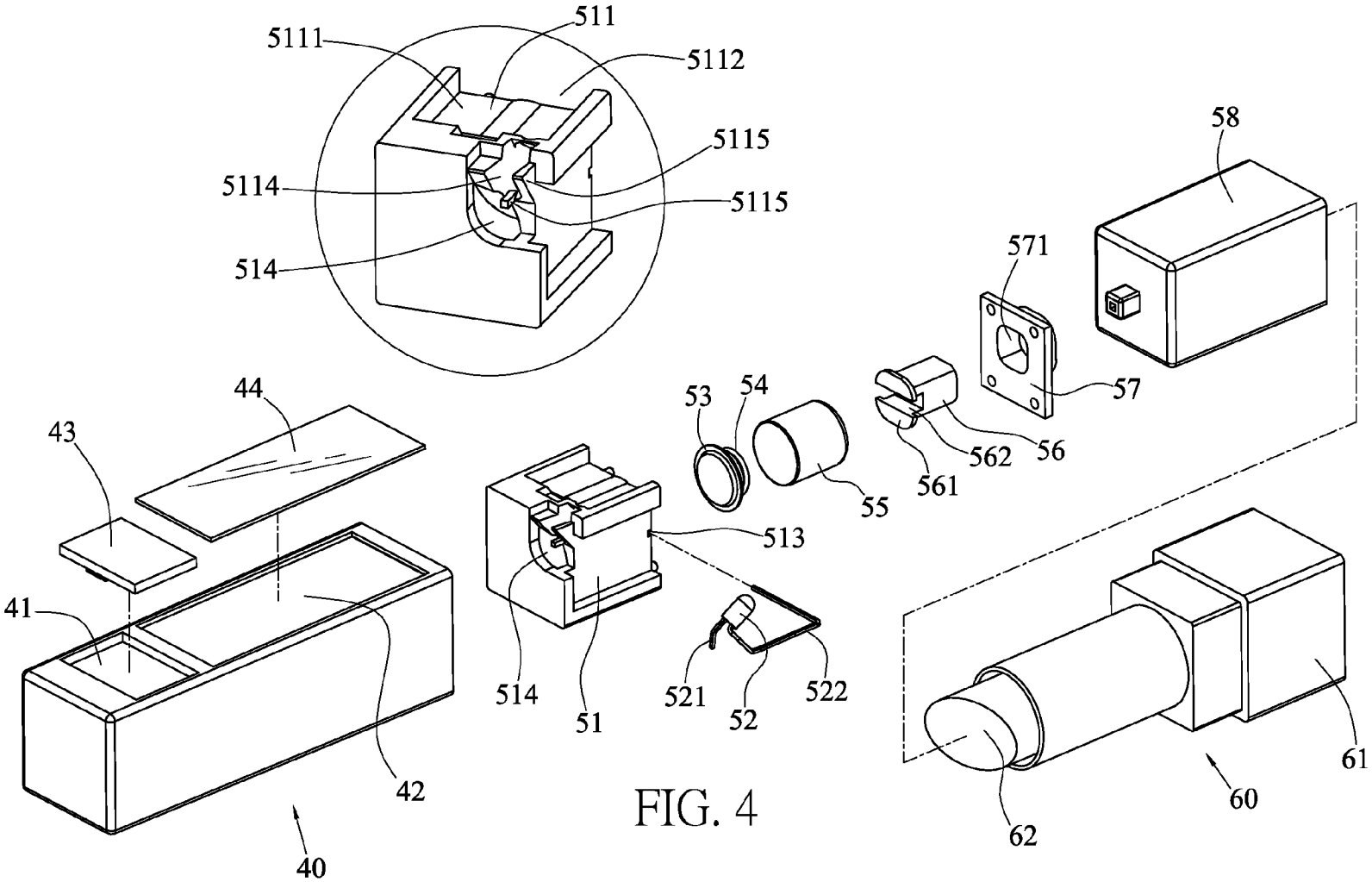
FIG. 4 is yet another exploded view of the cosmetic applicator.

Referring to FIGS. 1 to 7, a cosmetic applicator in accordance with the invention comprises a parallelepiped casing 40, a light and mount assembly 50, and a cosmetic element carrier 60. Each component will be discussed in detail below.

The casing 40 includes an opening member 41 on one surface, an opening element 42 on the same surface as the opening member 41 but larger than the opening member 41, a transparent glass 43 fitted on the opening member 41, a mirror 44 fitted on the opening element 42, and an internal space 45.

The light and mount assembly 50 includes a seat 51, a light 52, a conductive member 53, a conductive spring member 54, a battery 55, a moveable member 56, a stop member 57, and a case 58. The light and mount assembly 50 is disposed in the space 45. The seat 51 includes a reflective cavity 511 on a top, first and second openings 5111, 5112 on a top and a rear end of the reflective cavity 511 respectively, a front inclined surface 5113 sloping toward the reflective cavity 511, an inclined receptacle 5114 in the inclined surface 5113, and a plurality of supports 5115 on the periphery of the receptacle 5114.

The light 52 is disposed in the receptacle 5114 and is held in place by the supports 5115. Light emanating from the light 52 travels to the reflective cavity 511 and the inclined surface 5113 respectively. And in turn, the light is reflected toward the mirror 44 and the glass 43 respectively. The light 52 is implemented as an LED (light-emitting diode). The light 52 includes a contact 521 and a bent conductor 522.

The seat 51 further includes a cylindrical battery compartment 512 under the reflective cavity 511, the battery compartment 512 having a rear opening on the same surface as the second opening 5112, and two opposite slots 513 on the rear opening of the battery compartment 512. The conductive member 53, the conductive spring member 54, the battery 55, and the moveable member 56 are mounted in the battery compartment 512 from the front end to the rear opening of the battery compartment 512 in which the conductive spring member 54 is biased between and electrically interconnected the conductive member 53 and the battery 55.

The seat 51 further includes a channel 514 under the supports 5115, the channel 514 communicating with the battery compartment 512. The contact 521 is disposed in the channel 514 and electrically connected to the conductive member 53. The conductor 522 is engaged with the outer surface of the seat 51 and fastened by the slots 513 by snapping. The conductor 522 is not in contact with the battery 55 in an inoperative position. The moveable member 56 includes an enlarged front pushing member 561, a transverse groove 562 through the pushing member 561 and a portion of the moveable member 56 adjacent to the pushing member 561, the groove 562 being configured to loosely receive a portion of the conductor 522.

The rectangular stop member 57 is engaged with a rear opening of the battery compartment 512 and has a central hole 571 with an intermediate portion of the moveable member 56 moveably disposed therein in the inoperative position. The pushing member 561 is greater than a diameter of the central hole 571 and spaced apart from the central hole 571 in an inoperative position. An internally hollowed rear portion of the moveable member 56 is fastened on a forward projection of the case 58. The cosmetic element carrier 60 includes a rear body 61 and a front cosmetic element 62. The cosmetic element 62 is implemented as a lipstick, a lip gloss, a lip liner, a lip plumper, a lip balm, a lip conditioner, a lip primer, lip polish, lip brush, mascara brush, eyebrow pencil or a lip booster. The cosmetic element carrier 60 is releasably secured to a rear end of the casing 40 with the cosmetic element 62 disposed in the case 58.

Figure 5:
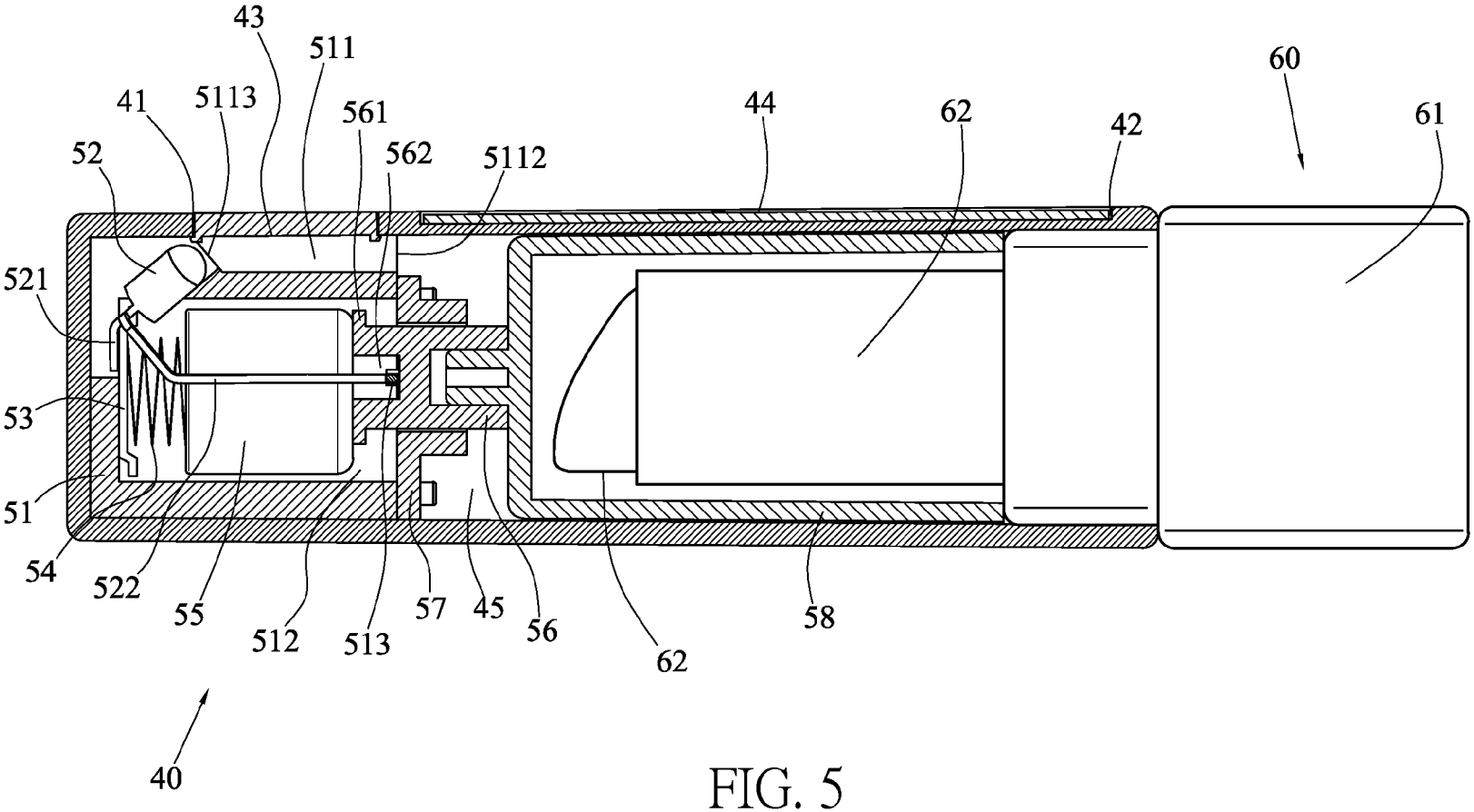
FIG. 5 is a longitudinal sectional view of the cosmetic applicator in FIG. 1.

As shown in FIG. 5, in the inoperative position, the cosmetic element carrier 60 is releasably secured to a rear end of the casing 40 with the case 58 and the moveable member 56 secured together, the moveable member 56 engaged the rear end of the battery 55, the conductive spring member 54 is compressed, and the conductor 522 electrically disconnected from the battery 55. Thus, the light 52 is turned off.

Figure 6:
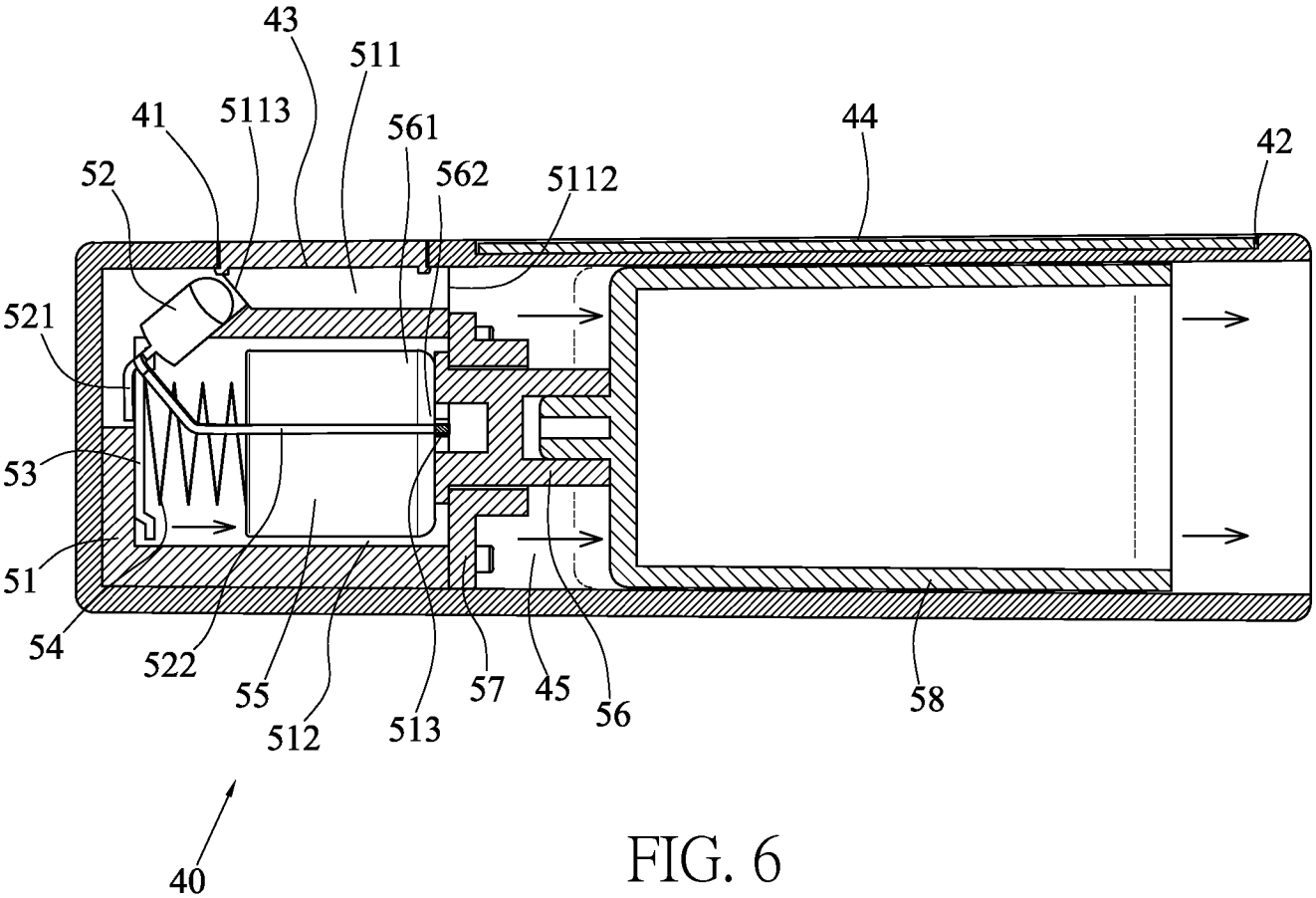
FIG. 6 is a view similar to FIG. 5 with the lipstick carrier removed and the case being pushed outward by the expansion of the spring member.
Figure 7:
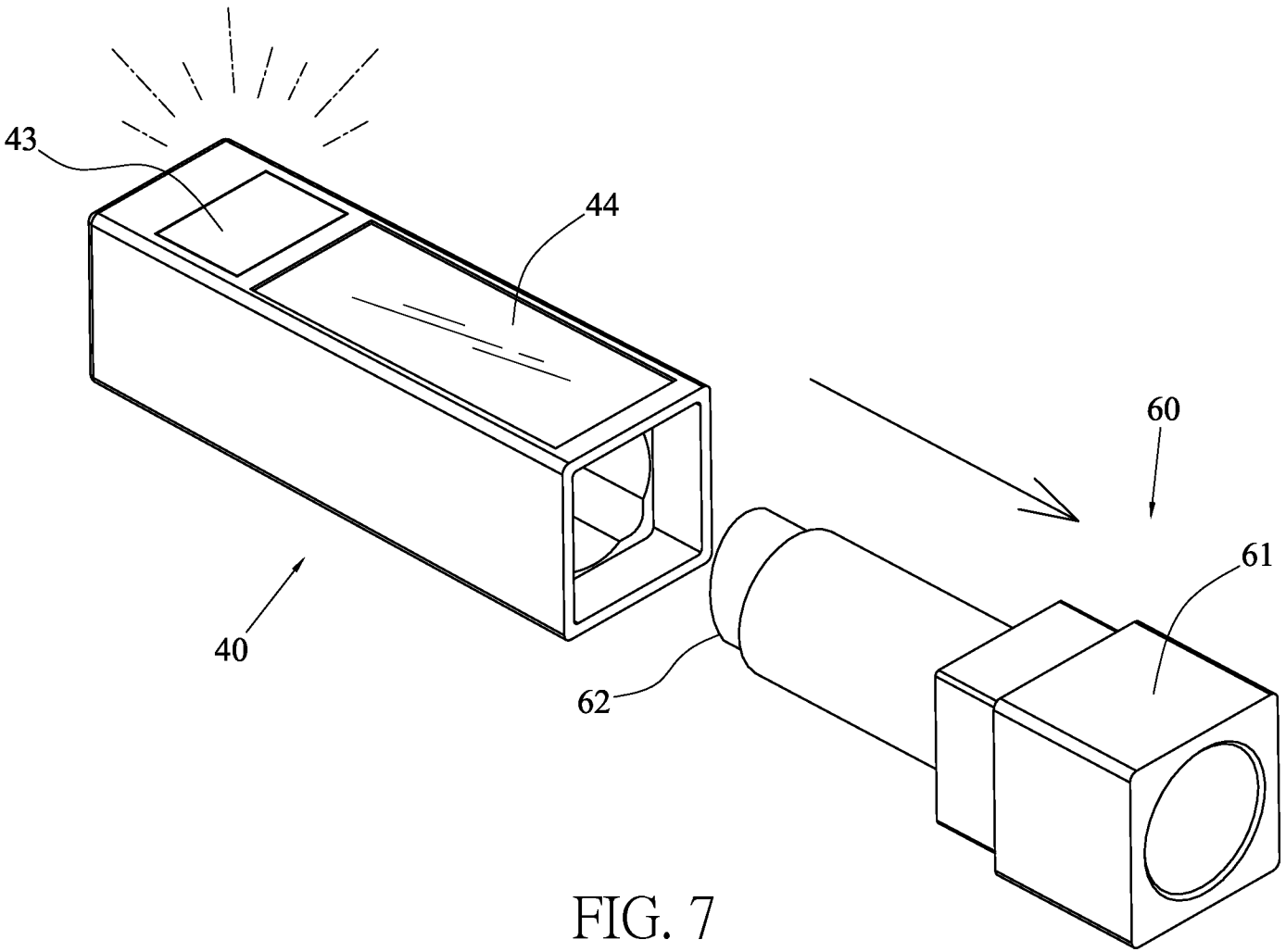
FIG. 7 is a perspective view of the cosmetic applicator showing the lipstick carrier removed and light being emitted corresponding to FIG. 6.
Figure 8:
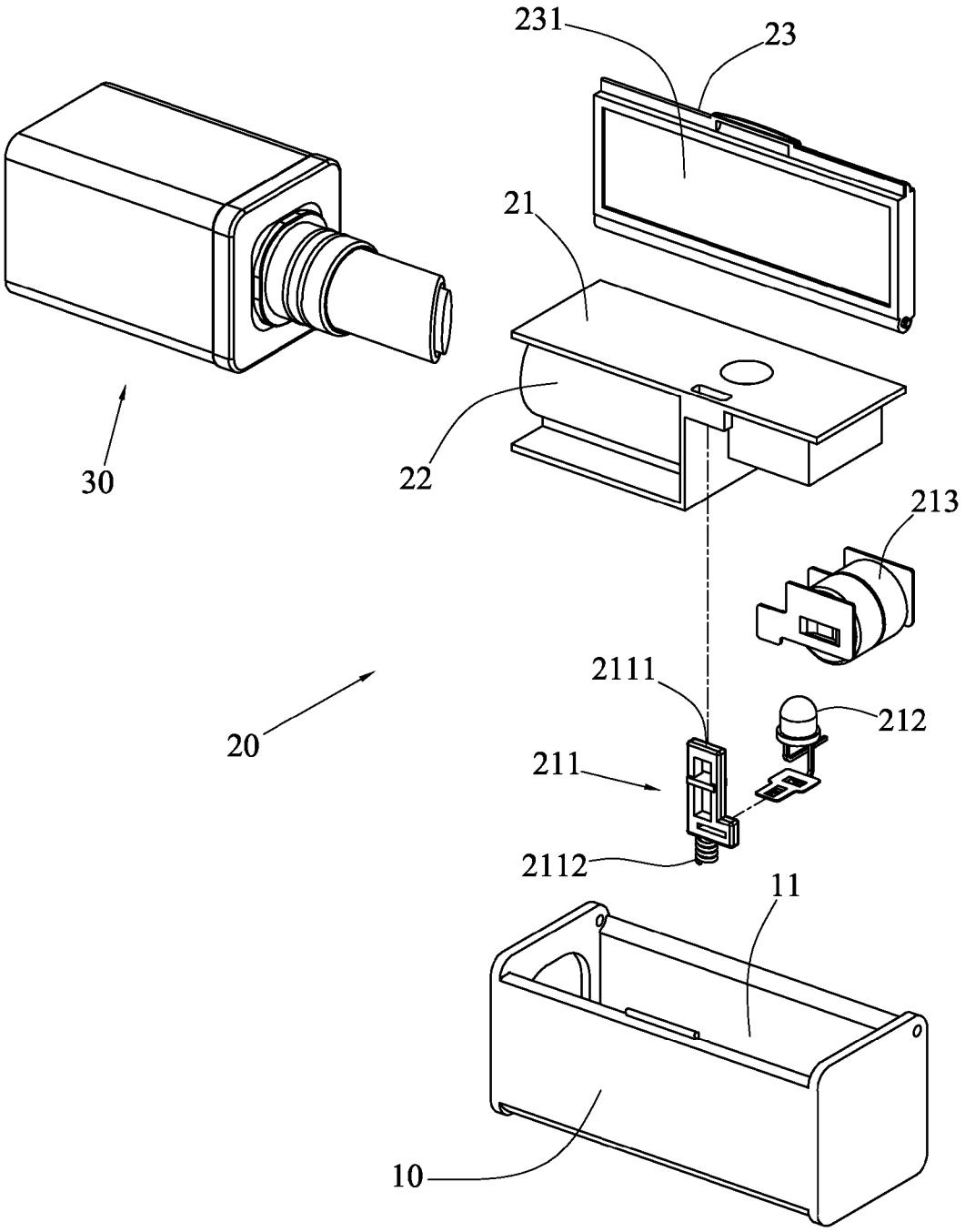
FIG. 8 PRIOR ART
FIG. 8 is an exploded view of a conventional cosmetic applicator with a light.

As shown in FIGS. 6 and 7, in use a person may disengage the cosmetic element carrier 60 from the casing 40 by pulling. Thus, the case 58 is not limited by the cosmetic element carrier 60. Further, the energized, conductive spring member 54 expands to push the battery 55 rearward until being stopped by the conductor 522. At this position, a circuit consisting of the battery 55, the conductor 522, the light 52, the contact 521, the conductive member 53, and the conductive spring member 54 is formed. As a result, the light 52 is turned on to emit light which passes through the mirror 44 and the glass 43 respectively.

It is envisaged by the invention that a simple removal of the cosmetic element carrier 60 can automatically turn on the light 52 for illuminating the cosmetic element 62. This is a great improvement in comparison with the conventional art which requires two steps.

While the invention has been described in terms of preferred embodiments, those skilled in the art will recognize that the invention can be practiced with modifications within the spirit and scope of the appended claims.

What is claimed is:

1. A cosmetic applicator comprising:

a casing including an opening member on one surface, an opening element on the same surface as the opening member, a transparent glass fitted on the opening member, a mirror fitted on the opening element, and an internal space;

a light and mount assembly disposed in the internal space and including a seat, a light, a conductive member, a conductive biasing member, a battery, a moveable member, a stop member, and a case wherein the seat has a battery compartment in a lower portion for anchoring the conductive member, the conductive biasing member, the battery, and the moveable member, and a channel communicating with the battery compartment; and wherein the light has one end passing through the channel to electrically connect to the conductive member and an other end spaced from the battery in an inoperative position; and a cosmetic element carrier includes a rear body and a front cosmetic element, and wherein the cosmetic element carrier is releasably secured to a rear end of the casing with the cosmetic element disposed in the case;

wherein the moveable member includes a front pushing element engaging the battery;

wherein the stop member is engaged with a rear opening of the battery compartment and has a central hole with a portion of the moveable member moveably disposed therein in the inoperative position;

wherein the pushing element is greater than a diameter of the central hole and spaced apart from the central hole in the inoperative position;

wherein an internally hollowed rear portion of the moveable member is secured to a front end of the case; and wherein the cosmetic element carrier includes a rear body and a front cosmetic element disposed in the case.

2. The cosmetic applicator of claim 1, wherein the light is an LED (light-emitting diode) which includes a contact and a conductor; wherein the contact is disposed in the channel and electrically connected to the conductive member; wherein the conductor is not in contact with the battery in an inoperative position; and wherein the moveable member includes an enlarged front end served as a pushing member, and a transverse groove through the front end of the moveable member, the transverse groove being configured to hold a portion of the conductor in place.

3. The cosmetic applicator of claim 2, further comprising two opposite slots on the rear opening of the battery compartment, and wherein the conductor is engaged with an outer surface of the seat and fastened by the slots.

4. The cosmetic applicator of claim 1, wherein the seat includes a reflective cavity on a top, first and second openings on a top and a rear end of the reflective cavity respectively, a front inclined surface sloping toward the reflective cavity, an inclined receptacle in the inclined surface, and a plurality of supports on a periphery of the receptacle; wherein the light is disposed in the receptacle and is held in place by the supports; wherein light emanating from the light travels to the reflective cavity and the inclined surface respectively; and wherein the light is further reflected toward the mirror and the transparent glass respectively.

5. The cosmetic applicator of claim 4, wherein the seat further comprises the battery compartment under the reflective cavity, the rear opening of the battery compartment being on the same surface as the second opening.

6. The cosmetic applicator of claim 4, wherein the seat further comprises a channel under the supports, the channel communicating with the battery compartment.

7. The cosmetic applicator of claim 1, wherein the cosmetic element is one of lipstick, lip polish, lip brush, mascara brush, and eyebrow pencil.

* * * * *